United States Patent [19]

Reith

[11] 4,304,073

[45] Dec. 8, 1981

[54] RACKED SECTION

[76] Inventor: Charles Reith, 14, rue Saint-Louis en l'Ile, 75004 Paris, France

[21] Appl. No.: 103,719

[22] Filed: Dec. 14, 1979

[30] Foreign Application Priority Data

Aug. 6, 1979 [FR] France ..... 79 14725

[51] Int. Cl.[3] ..... A47B 5/00

[52] U.S. Cl. ..... 52/36; 52/716; 108/108

[58] Field of Search ..... 52/36, 238, 239, 716, 52/718; 108/108

[56] References Cited

U.S. PATENT DOCUMENTS 4,070,803 1/1978 Gartung ..... 108/108 X
4,184,297 1/1980 Casamayor ..... 52/716

FOREIGN PATENT DOCUMENTS 166059 11/1955 Australia ..... 108/108
2331303 6/1977 France ..... 52/36

*Primary Examiner*—J. Karl Bell

[57] ABSTRACT

This racked section is of the metal twin-U type whose middle legs are joined together by the rack properly speaking and whose lateral legs are smaller in height than the preceding ones. It is fitted with ribbons of a flexible material which hide the means for fixing to their support the bottoms of the U of the section.

This fixing is obtained by providing along one of the edges of these ribbons means for clipping to the lateral legs of each U. The opposite edge of each ribbon is in the form of a thin lip overhanging the rack so as to partially hide it while allowing the introduction therein of brackets, stops, etc.

4 Claims, 4 Drawing Figures

RACKED SECTION

BACKGROUND OF THE INVENTION

The present invention relates to a shaped upright with toothed rack formed by a double U section, the adjacent middle legs of which are joined together by the rack and the bases of which are continued by two outwardly-directed right-angled bends, the first forming supports and provided with through-holes serve for fixing by means of screws to the support and the second, not as high as the section, as a possible stop for panels.

Camouflaging the section by means of counter-section arranged so as to hide the screws securing the section to its support has already been proposed (French Pat. Nos. 2 039 207 and 7 900 930), however the securing of these counter-sections raises great difficulties, does not allow them to be removed or loaded readily and requires a special construction of the sectional bar.

SUMMARY OF THE INVENTION

Now, in accordance with the present invention, a construction of a metal sectional bar with rack has been discovered to which may be readily and securely fitted counter-sections made from plastic material of any shape, color and size, which are interchangeable and which hide the rack almost completely.

Onto a rack in the shape of two Us with parallel legs of unequal heights there is clipped, to the lateral legs of the Us, two counter-sections comprising on their free edge opposite the rack flexible lips hiding the perforations of the rack while allowing interlocking of all the accessories, brackets, securing locks, etc. . . .

The fixing of each counter-section is achieved by forming at the base of the counter-section a groove which is force-fitted over the lateral leg of the U of the sectional bar.

This groove and the leg of the section are preferably indented to improve the fixing.

The groove at the base of the counter-section may be provided in any way, for example by forming during moulding a fork or groove whose width is at most equal to that of the lateral leg of the section on which it is engaged.

Reverse fixing could be considered by providing a slot in the lateral leg of the section in which the lateral leg of the section will be fitted.

The clipping of the counter-section may be made on the front and no longer at the side of an upright already in position, for example from the floor to the ceiling.

It thus becomes possible to change inexpensively one counter-section having a certain shape or color for a counter-section adapted to the environment.

Since the screws for securing the sections to a support are hidden by the counter-section while remaining easily accessible, all sorts of fixing means may be used particularly screws without counter-sinking.

It is to be noted that the section may be used without a counter-section, for example for placing panels in abutment on the lateral legs and against the middle legs of the section.

DESCRIPTION OF THE DRAWINGS

There will be described in more detail hereafter one embodiment of an assembly comprising shaped upright and counter-section or mask in accordance with the invention, with reference to the accompanying drawings in which.

DESCRIPTION OF THE PREFERRED EMBODIMENT(S)

Figure 1:
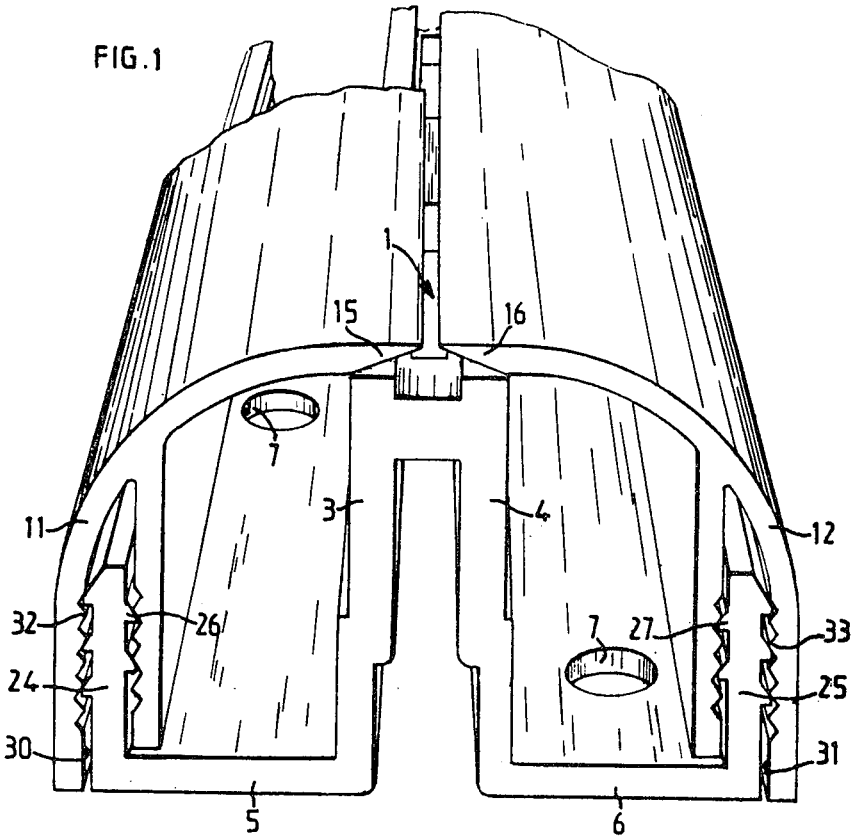
FIG. 1 is a perspective view from bottom to top of this assembly with a part cut away.
Figure 3:
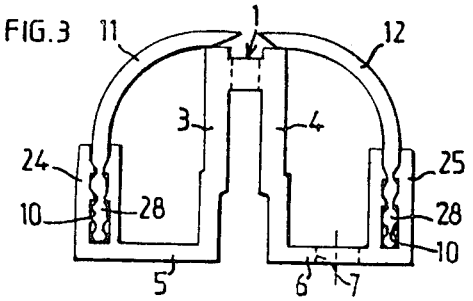
FIG. 3 is a sectional view of a variation.

The section is of the twin-U type whose parallel middle legs 3, 4 form between them the rack 1 and are joined at the base to portions 5, 6 bent outwardly at right-angles and intended to be fixed to the support, wall or dividing wall, by means of screws (not shown) engaged in bores 7.

These portions bent back at right-angles are connected portions 24,25 bent back at right-angles which form the lateral legs of the U-shaped section and are smaller in height than the middle legs 3, 4.

These lateral legs present preferably indentations 26, 27.

Onto this sectional upright are clipped the counter-sections 11, 12 having any curved or flat shape, any dimension and any color which are intended to hide the means securing the section to its support and even partially the toothed rack.

This clipping may be achieved by providing during moulding, at the base of each counter-section, a groove 30, 31 whose width is at most equal to that of the lateral legs of the section, whose length is approximately equal to the height of legs 24, 25 and which is preferably provided with indentations 32, 33, cooperating with the indentations 26, 27 of the legs when each counter-section is force-fitted on each leg of the section.

Figure 2:
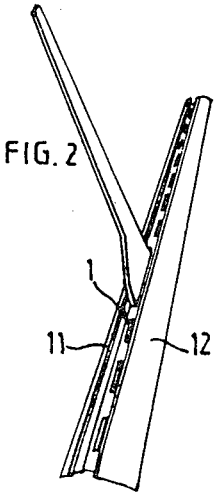
FIG. 2 is a perspective view of a bracket in place on the rack.

The free ends 15, 16 of the counter-sections 11, 12 are cut out to form flexible lips so as to partially hide the rack 1 while allowing brackets to be introduced therein (FIG. 2).

Instead of a moulded base for each counter-section 11, 12 in the shape of a fork, in each leg 24, 25 there may be provided a slot 10 preferably indented on the inside in which the indented base 28 of each counter-section is force-fitted.

Wishing to use this sectional upright bar for mounting side panels, the counter-sections are dispensed with, the panels resting, as described in the above-mentioned French Pat. No. 1 506 353, on the side legs 24, 25 of the section abuting thereon and against the middle legs 3, 4.

For an end rack, a single mask may be used harmonizing with the environment.

The positioning or the removal of the counter-sections, is effected without difficulty and without damaging either the section or the counter-sections, even if these latter are made from a flexible material such as PVC.

Counter-sections may also be used made from a light metal, such as aluminium: in this case the securing of each counter-section on the upright may be improved by providing an inner tongue extending from the free edge of the counter-section and which is applied against the middle legs of the section.

Figure 4:
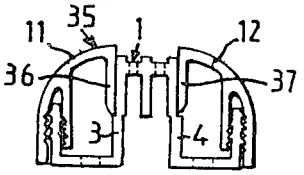
FIG. 4 is a sectional view of a shaped upright with a counter-section made from a light metal, from aluminium for example.

There is thus shown in FIG. 4 a sectional upright 35 with a rack 1 having a double perforation and counter-sections 11, 12 which present along their free edge a tongue 36, 37 which is applied against the middle legs 3, 4 of the section so as to provide a complementary securing of the counter-sections to the upright.

It is to be understood that, without departing from the spirit and scope of the invention, several uprights with racks may be combined to form an assembly in the form of a tubular post having several racks in different planes.

It is apparent that within the scope of the invention, modifications and different arrangements can be made other than is here disclosed. The present disclosure is merely illustrative with the invention comprehending all variations thereof.

We claim:

1. A shaped upright with rack for fixing to any support whatever, having a double U section with median parallel legs joined by the rack and lateral legs which are smaller in height than the median legs, the bottoms of the Us being pierced with apertures for passing therethrough means for fixing to the support, a pair of removable masks in the shape of countersections made from a flexible material capable of completely surrounding the shaped upright, each countersection having at its outer edge means for clipping to a lateral leg of the shaped upright.

2. A shaped upright with rack for fixing to any support whatever, with a double U section whose median parallel legs are joined by the rack and whose lateral legs are smaller in height than the median legs, the bottoms of the Us being pierced with apertures for passing therethrough means for fixing to the support, associated with a pair of removable masks in the form of countersections made from a flexible material capable of completely surrounding the shaped upright, each countersection having at its outer edge means for clipping to a lateral leg of the shaped upright and at its inner edge overhanging the rack a flexible lip.

3. A shaped upright with rack for fixing to any support whatever, having a double U section with median parallel legs joined by the rack and lateral legs which are smaller in height than the median legs, the bottoms of the Us being pierced with apertures for passing therethrough means for fixing to the support, a pair of removable masks in the form of countersections made from a flexible material capable of completely surrounding the shaped upright, each countersection having at its outer edge an indented groove of a length at least equal to the height of the lateral leg of the shaped upright and this lateral leg of the shaped upright being indented to cooperate with the indentation of the groove of the countersection.

4. A shaped upright with rack for fixing to any support whatever having a double U section with median parallel legs joined by the rack and lateral legs which are smaller in height than the median legs, the bottoms of the Us being pierced with apertures for passing therethrough means for fixing to the support, a pair of removable masks in the form of countersections made from a flexible material capable of completely surrounding the shaped upright, the outer edge of each countersection being indented and the lateral leg of the shaped upright being given the shape of an indented groove receiving the indented edge of the countersection for fixing thereof to the shaped upright.

* * * * *

UNITED STATES PATENT AND TRADEMARK OFFICE

CERTIFICATE OF CORRECTION

PATENT NO. : 4,304,073

DATED : December 8, 1981

INVENTOR(S) : Charles Reith

It is certified that error appears in the above-identified patent and that said Letters Patent are hereby corrected as shown below:

On the title page Insert:

-- [30] Foreign Application Priority Data
June 8, 1979 France 79 14725 --

Signed and Sealed this

*Twenty-sixth* Day of *April 1983*

[SEAL]

*Attest:*

GERALD J. MOSSINGHOFF

*Attesting Officer*

*Commissioner of Patents and Trademarks*